US008240464B2

(12) United States Patent
Clishem

(10) Patent No.: US 8,240,464 B2
(45) Date of Patent: Aug. 14, 2012

(54) HANGING GARMENT STORAGE UNIT

(76) Inventor: Catherine Grace Clishem, San Diego, CA (US)

( * ) Notice: Subject to any disclaimer, the term of this patent is extended or adjusted under 35 U.S.C. 154(b) by 404 days.

(21) Appl. No.: 12/538,429

(22) Filed: Aug. 10, 2009

(65) Prior Publication Data

US 2011/0031140 A1 Feb. 10, 2011

(51) Int. Cl.
*B65D 85/18* (2006.01)

(52) U.S. Cl. ..... 206/286; 312/322; 190/29; 190/31; 190/33; 190/13 H; 211/113; 211/116; 211/96; 211/104

(58) Field of Classification Search ..... 312/322; 190/29–34, 13 R–13 H; 206/286; 211/113, 211/115, 116, 96, 104
See application file for complete search history.

(56) References Cited

U.S. PATENT DOCUMENTS

| | | | | | |
|---|---|---|---|---|---|
| 559,068 | A * | 4/1896 | Vess et al. | 312/131 |
| 732,670 | A * | 6/1903 | Watkins et al. | 190/13 R |
| 1,083,415 | A * | 1/1914 | Sorensen | 312/322 |
| 1,645,992 | A * | 10/1927 | Hinde | 190/19 |
| 1,893,570 | A * | 1/1933 | Waite | 211/85.3 |
| 2,051,273 | A * | 8/1936 | Phillips | 190/13 R |
| 3,014,773 | A * | 12/1961 | Foote, Jr. | 312/323 |
| 3,729,099 | A * | 4/1973 | Kritske | 211/46 |
| 4,314,733 | A * | 2/1982 | Smith | 312/183 |
| 4,620,635 | A * | 11/1986 | Morand | 211/47 |
| 4,693,345 | A * | 9/1987 | Mittelmann | 190/108 |
| 4,738,340 | A * | 4/1988 | Crespi | 190/18 R |
| 4,953,714 | A * | 9/1990 | Paul | 211/36 |
| 5,066,079 | A * | 11/1991 | Lawrence | 312/204 |
| 8,028,844 | B2 * | 10/2011 | Costa et al. | 211/96 |
| 2011/0062101 | A1 * | 3/2011 | Todd, Jr. | 211/144 |

FOREIGN PATENT DOCUMENTS

| | | |
|---|---|---|
| FR | 2768598 | 3/1999 |
| GB | 862275 | 3/1961 |
| WO | WO00/72720 | 12/2000 |

* cited by examiner

*Primary Examiner* — Tri Mai
(74) *Attorney, Agent, or Firm* — Fish & Richardson P.C.

(57) ABSTRACT

A hanging garment storage unit includes a hanger, a frame, and a drawer. The hanger is arranged to removably couple the frame to an external support. The frame has a broad side and a top. A track is coupled to the broad side of the frame, and the drawer is slidably coupled to the frame. The frame has a broad side and a narrow side, and the drawer is arranged to slide along the track with the broad side of the drawer facing the broad side of the frame. The drawer is further arranged to pivot about an end of the frame to allow movement of the drawer from a storage position to an access position.

19 Claims, 6 Drawing Sheets

HANGING GARMENT STORAGE UNIT

FIELD OF INVENTION

This invention relates to a hanging storage unit for garments.

BACKGROUND

Hanging storage units have been designed for a variety of purposes, including storing, organizing, and protecting garments.

SUMMARY

In one aspect, a hanging garment storage unit includes a frame with a broad side and a top, a hanger arranged to removably couple the frame to an external support, and a drawer. The broad side of the frame includes a track. The drawer has a broad side and a narrow side, and is arranged to slide along the track with the broad side of the drawer facing the broad side of the frame. The drawer is further arranged to pivot about an end of the frame to allow movement of the drawer from a storage position to an access position.

In another aspect, a hanging garment storage unit includes a frame with a top and a broad side, a hanger coupled to the top of the frame, and a drawer. The storage unit is configured to hang from an external support such that the frame extends vertically below the hanger. The drawer includes a broad side and a narrow side. The broad side of the drawer is slidably coupled to the broad side of the frame and substantially parallel to the broad side of the frame when the drawer is in a storage position. The drawer is also pivotable about an end of the frame such that the broad side of the drawer is substantially perpendicular to the broad side of the frame in an access position.

Certain implementations may include one or more of the following features. The storage unit may be configured to hang from a rod in a closet such that the narrow side of the drawer is substantially parallel to the length of the rod. The storage unit may include two or more drawers. The broad side of the drawer may be substantially parallel to the broad side of the frame in the storage position, and substantially perpendicular to the broad side of the frame in the access position.

The drawer may include rails pivotably coupled to and extending from the narrow side of the drawer. The rails may be removably coupled to a second narrow side of the drawer. The second narrow side of the drawer may include a grip to allow a user to pull the drawer along the track to an extended position. The rails may include clips configured to secure garments, such as lingerie, to the rails. In some cases, the interior of the drawer is accessible through an opening in the top of the drawer. In certain cases, the inside of the drawer is accessible through an opening in a second broad side of the drawer. The drawer may include doors hingedly coupled to the drawer, such that the doors, when closed, form a portion of the second broad side of the drawer. The doors may be arranged to be opened to expose contents of the drawer when the drawer is in the access position. A side of the drawer may be at least partially transparent or translucent. For example, a narrow side (e.g., the second narrow side) of the drawer may include a transparent or translucent material such as a sheer plastic or fabric. In some cases, an inside surface of a door includes a storage pocket.

DETAILED DESCRIPTION

Figure 1:
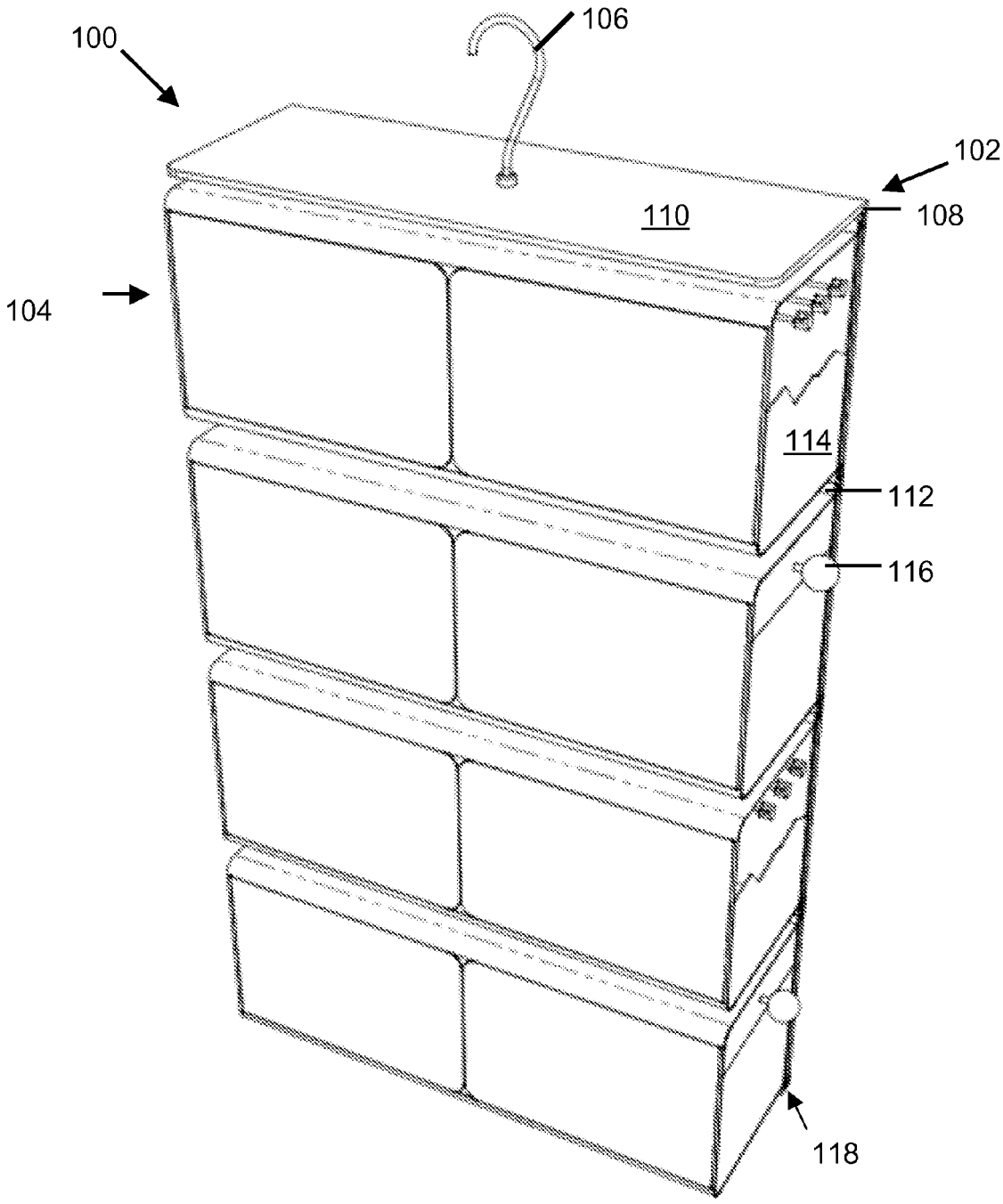
FIG. 1 illustrates a hanging garment storage unit.
Figure 2:
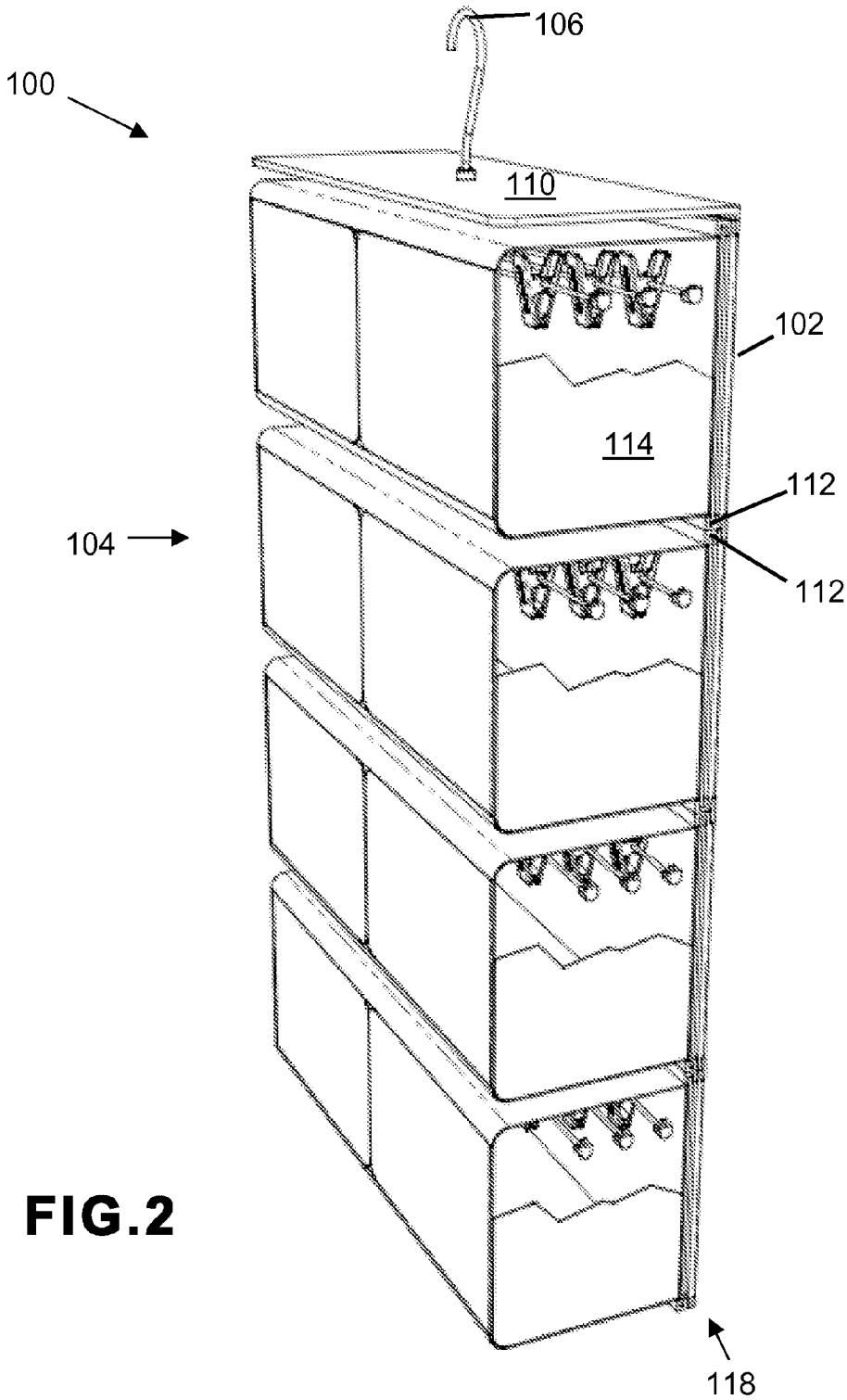
FIG. 2 illustrates a hanging garment storage unit.

As illustrated in FIG. 1 and FIG. 2, a hanging garment storage unit 100 has a frame 102, drawers 104, and hanger 106. Frame 102 includes a broad side 108 and a top 110. The frame is constructed to support drawers 104 and allow movement of the drawers 104 with respect to the frame. The frame 102 can have one or more tracks 112 extending along the broad side 108. For example, the frame 102 may have one, two, or three tracks 112 for each drawer 104. In some cases, the tracks 112 are substantially parallel to each other. Each track 112 may include two, three, or more segments (e.g., a long segment and a shorter end segment, two end segments and a center segment, etc.) based on the desired rotation of the drawer with respect to the frame. The hanger 106 is coupled to or extends from the top 110 of the frame 102 such that the storage unit 100 may be hung from an external support (e.g., a horizontal rod), with the frame 102 extending vertically below the hanger.

Some or all of the hanging storage unit 100, including the frame 102, the drawers 104, or any combination thereof, may be constructed from sturdy material such as, for example, cardboard, fiberboard, plastic, hard foam polyurethane, or the like, or any combination thereof. Portions of the hanging storage unit 100 may be covered to alter the appearance of the unit. The hanging storage unit 100 can be covered, for example, with a woven or non-woven fabric, paper, or polymeric layer or coating. The hanger 106 can be fabricated from metal, plastic, wood, or other material, and may be in the shape of a hook, loop, strap, or the like. Tracks 112 may be made of metal, plastic, sturdy cardboard, light fiberboard, hard foam polyurethane, or other material capable of holding drawers 104 in the frame 102 and allowing the drawers to slide and pivot with respect to the frame.

Drawers 104 in FIGS. 1 and 2 are in the storage position. In the storage position, the hanging storage unit 100 may be positioned, for example, on a rod in a closet such that a user faces a narrow side 114 of drawers 104. Contents of drawers 104 may be visible in the storage position if, for example, a portion of narrow side 114 of the drawer includes a transparent or translucent material such as a sheer plastic or fabric (e.g., such as chiffon, organza, batiste, organdy, or the like, or any combination thereof).

Narrow side 114 of drawer 104 can include grip 116. In some examples, the grip is a knob, a loop, a pull, a strap, a hole, a depression, or the like. In some cases, grip 116 is mounted on a stabilizing strip with a surface area of about 25% or less of the surface area of narrow side 114. In certain embodiments, grip 116 includes a stiff material such as cardboard, wood, plastic, or the like, and may be covered in a fabric such as a silk, nylon, cotton, or the like.

Figure 3:
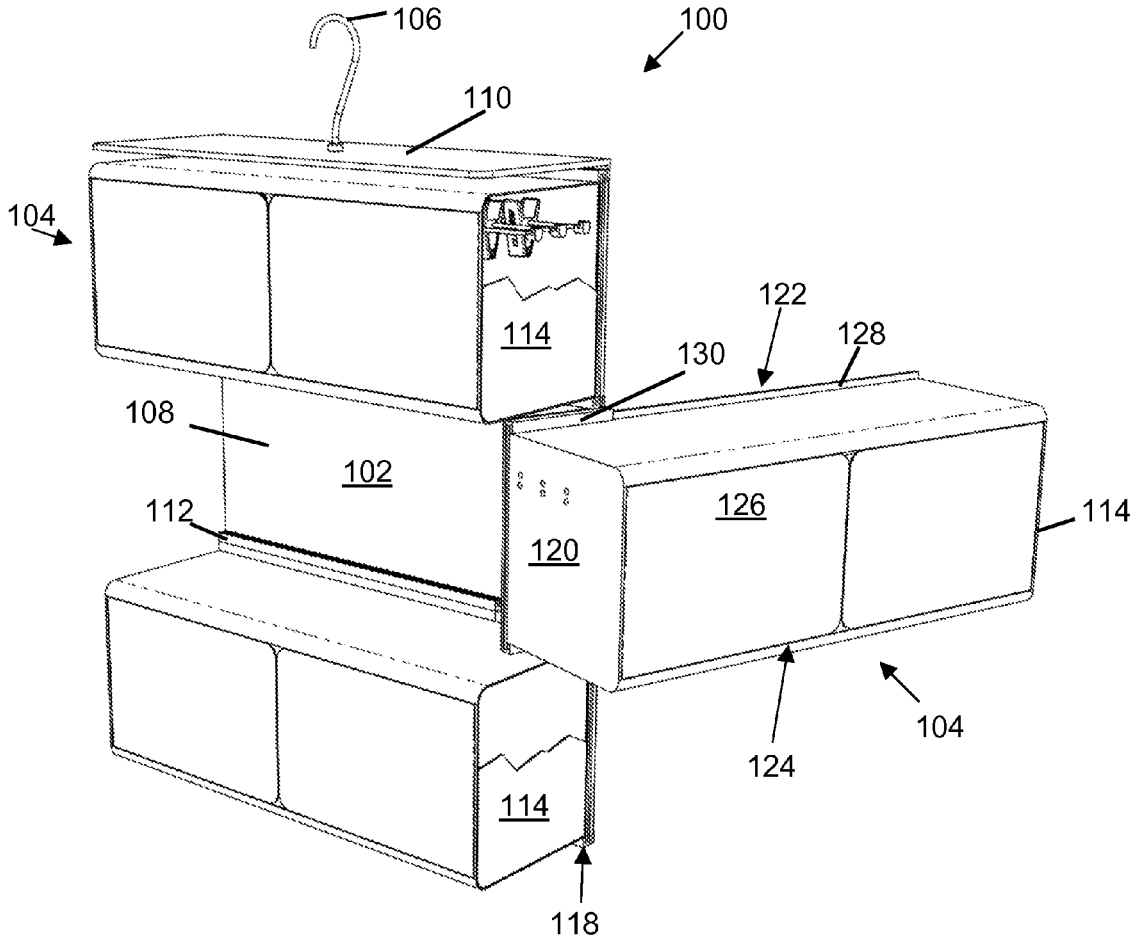
FIG. 3 illustrates a hanging garment storage unit with a drawer pivoted about an end of the frame.

FIG. 3 shows drawer 104 pivoted about an end 118 of the frame 102. Drawer 104 includes narrow sides 114 and 120, broad sides 122 and 124, and top 126. Extensions 128, on the top and bottom of broad side 122, are slidably coupled to tracks 112 to allow drawers 104 to slide along a length of tracks 112. For example, a user may grasp grip 116 of drawer 104 and pull the drawer along the tracks 112. As shown by the middle drawer 104 in FIG. 3, a segment 130 of track 112 is pivotable about the end 118 of frame 102 to allow drawer 104, in an extended position, to be pivoted about the end of the frame. With drawer 104 in the extended position and the pivotable segment 130 of the track 112 rotated about the end 118 of the frame 102, the drawer may be slid back through the pivotable segment of the track to more evenly position the drawer about the pivotable segment of the track, as shown in FIG. 4.

Figure 4:
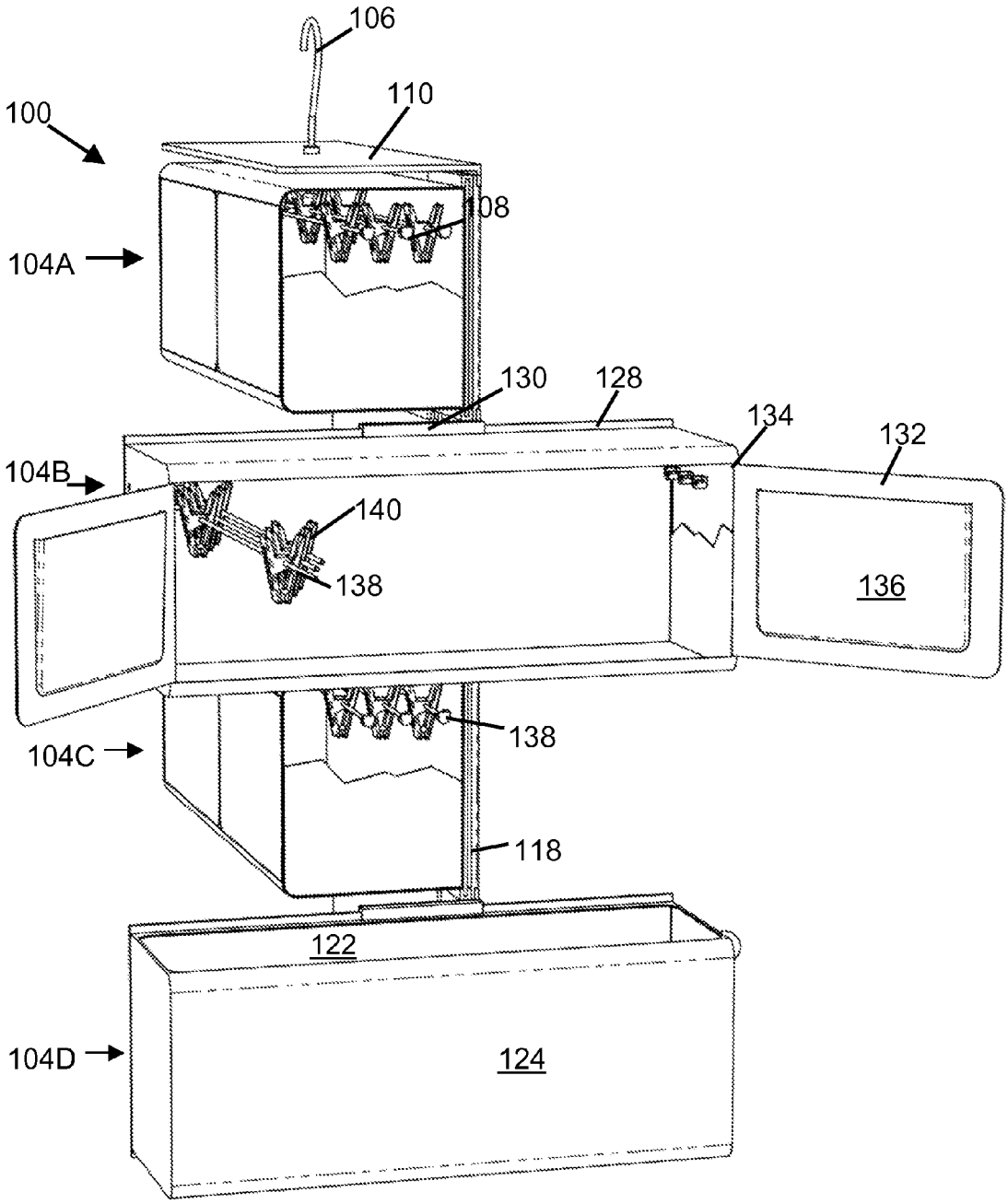
FIG. 4 illustrates a hanging garment storage unit with two drawers in the storage position and two drawers in the access position.

FIG. 4 illustrates hanging storage unit 100 with drawers 104A and 104C in the storage position, and two drawers 104B and 104D in a pivoted or access position. In the storage position, broad sides 122 and 124 of drawers 104A and 104C may be substantially parallel to broad side 108 of frame 102. In the access position, broad sides 122 and 124 of drawers 104B and 104D may be substantially perpendicular to broad side 108 of frame 102. That is, movement of a drawer 104B from a storage position to an access position includes rotation of the drawer by about 90° about end 118 of the frame 102, such that broad side 124 of drawer 104B in the access position is substantially parallel to narrow side 114 of drawer 104A in the storage position.

As shown in FIG. 4, broad side 124 of drawer 104B includes doors 132. Doors 132 may be hinged at edges 134 of drawer 104B to allow a user to access the contents of drawer 104B by opening the doors. Doors 132 may have a grip, similar to grip 116, to facilitate opening. In some cases, doors 132 may be secured to the drawer 104B in a closed position by, for example, a hook and loop fastener, a magnetic fastener, and the like. Doors 132 may include one or more storage pockets 136 for holding clothing, accessories, jewelry, or other items. Storage pockets 136 may be made of fabric, such as silk, nylon, cotton, or the like. In some cases, as shown by drawer 104D, the drawer may have a solid broad side 124, with an opening in (or in place of) top 126, to allow a user to access items stored in drawer 104D.

Garments may be coupled to rails 138 extending from narrow side 120 to narrow side 114 of drawer 104. For example, each rail 138 may include one or more clips 140 for securing garments to the rails. Rails 138 are visible through the partially cut-away narrow sides 114 of the drawers 104A and 104C. Rails 138 may be made of metal, plastic, wood, fiberboard, a combination thereof, or any other material sufficient to support the weight of a garment. In some cases, rails 138 are covered in fabric such as velvet, cotton, silk, nylon, suede, terrycloth, and the like.

Figure 5:
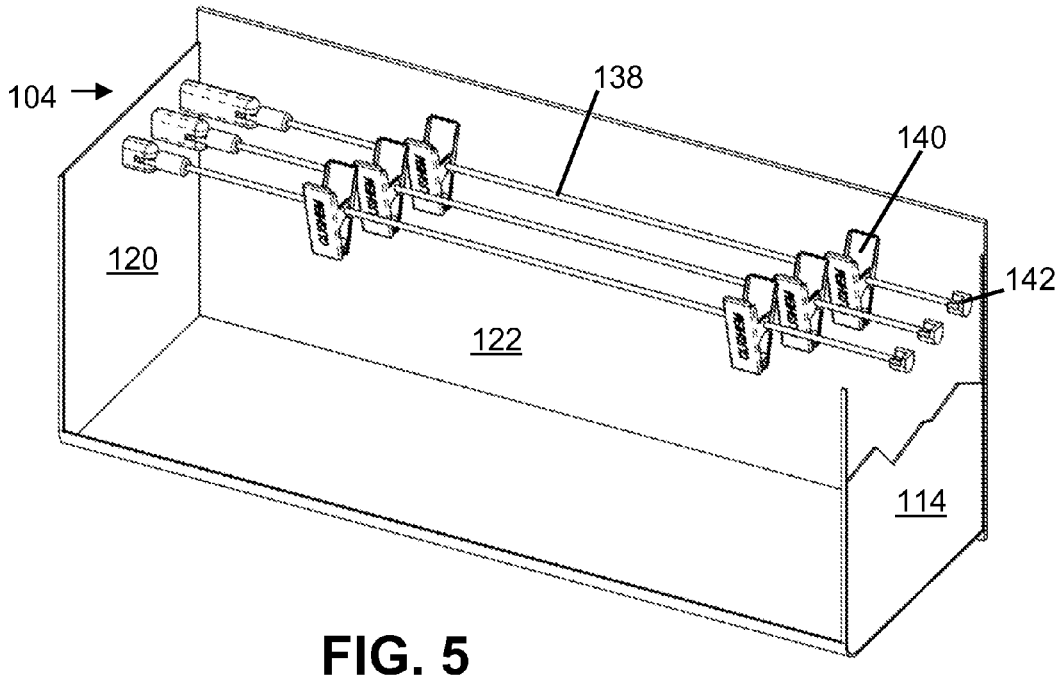
FIG. 5 illustrates a cut-away view of a drawer of a hanging garment storage unit.
Figure 6:
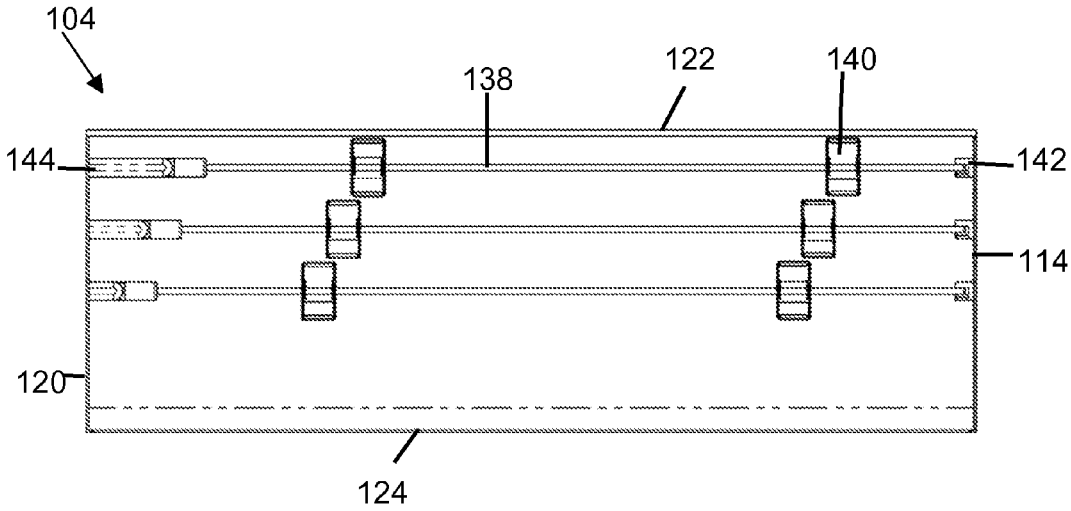
FIG. 6 illustrates rails in a drawer of a hanging garment storage unit.

In some embodiments, as shown in more detail in FIG. 5, rails 138 are hinged at narrow side 120 of drawer 104, and are configured to engage with stays 142 on the narrow side 114 of the drawer. In the storage position of drawers 104A, one or more garments (e.g., bras) may be secured to clips 140 and stored with rails 138 engaged in stays 142. Clips 140 may be able to slide along rail 138. As shown in FIG. 6, clips 140 on rails 138 may be staggered along the rails so that clips on one rail do not interfere with clips on an adjacent rail. Clips 140, stays 142, and hinges 144 may be made of metal, plastic, wood or any combination of materials strong enough grip, store, and support garments. In some cases, clips 140 are covered in fabric such as velvet, cotton, silk, suede, terrycloth, or the like.

Figure 7:
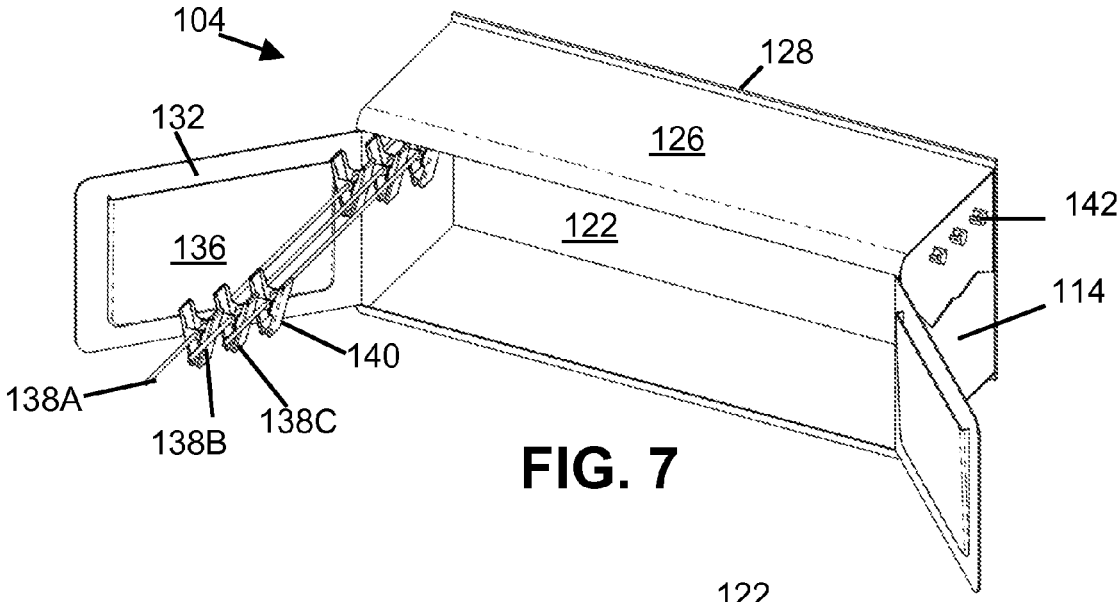
FIG. 7 illustrates an open drawer of a hanging garment storage unit.
Figure 8:
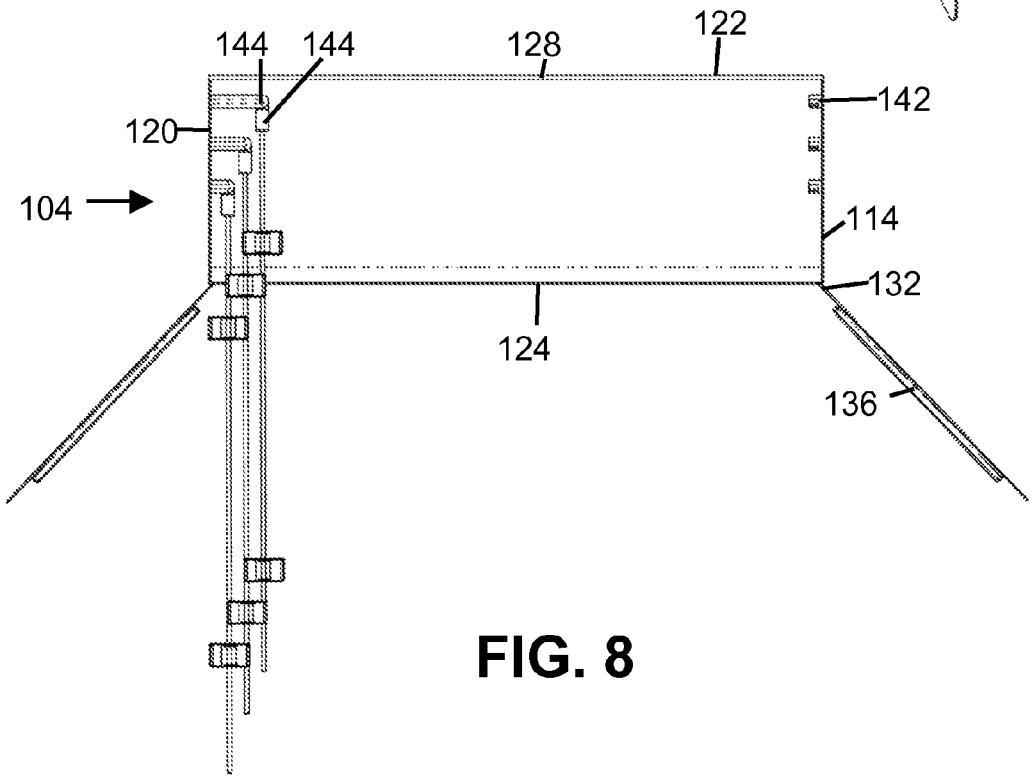
FIG. 8 illustrates a top view of an open drawer of a hanging garment storage unit with pivoted rails.

FIG. 7 shows a perspective view of drawer 104 with open doors 132. Rails 138A, 138B and 138C are disengaged from stays 142 and rotated clockwise about hinges 144 coupled to narrow side 120 of drawer 104 to allow a user to access garments clipped to the rails. As shown in FIG. 8, hinges 144 may be graduated in length such that rails 138 may be disengaged from the stays 142 and rotated (e.g., at least about 90°) so the user can reach a garment clipped to, for example, rail 138C without interference from garments clipped to rails 138A and 138B.

A number of embodiments of the invention have been described. Nevertheless, it will be understood that various modifications may be made without departing from the spirit and scope of the invention. For example, while the figures indicate counterclockwise rotation of the drawers from a storage position to an access position, the drawers may also be able to rotate clockwise, or both counterclockwise and clockwise, from a storage position to an access position, based on the configuration of the segments of the track coupled to the broad side of the frame. That is, when the storage unit is hanging from the hanger and the drawers are in the storage position, such that a user is facing the narrow side of the drawers with the receiving latches, the doors of the drawers may face either left or right. Similarly, hinged rails in a drawer may be extended from the drawer by clockwise rotation, counterclockwise rotation, or any combination thereof.

What is claimed is:

1. A hanging garment storage unit, comprising:

a frame comprising a single broad side and a top, wherein the single broad side comprises a track, the track comprising segment pivotable about an end of the single broad side of the frame;

a hanger arranged to removably couple the frame to an external support; and a drawer comprising a first broad side, a second broad side opposite and parallel to the first broad side, and two narrow sides, the narrow sides unbounded by the frame when the drawer is in a storage position, wherein the drawer is arranged to slide along the track with the first broad side of the drawer facing the single broad side of the frame, the second broad side comprising two doors, each door hinged proximate one of the narrow sides of the drawer, the doors hinged at opposite edges of the drawer and in a plane parallel to the broad side of the frame, such that each door, when at least partially opened, forms an angle greater than 90° with respect to the interior side of the narrow side of the drawer proximate which it is hinged, and wherein the pivotable segment is arranged to pivot the drawer about the end of the single broad side of the frame to allow movement of the drawer from a storage position to an access position.

2. The storage unit of claim 1, wherein the first broad side of the drawer is substantially parallel to the single broad side of the frame in the storage position.

3. The storage unit of claim 1, wherein the first broad side of the drawer is substantially perpendicular to the single broad side of the frame in the access position.

4. The storage unit of claim 1, further comprising rails extending from at least one of the narrow sides of the drawer.

5. The storage unit of claim 4, wherein the rails are configured to secure garments in the drawer.

6. The storage unit of claim 5, wherein the garments comprise lingerie.

7. The storage unit of claim 1, wherein the doors, when opened, expose contents of the drawer when the drawer is in the access position.

8. The storage unit of claim 1, wherein the doors comprise storage pockets.

9. The storage unit of claim 1, wherein the storage unit is configured to hang on a rod in a closet such that the narrow sides of the drawer are substantially parallel to the length of the rod.

10. A hanging garment storage unit comprising:

a frame comprising a top and a single broad side, wherein the single broad side comprises a track, the track comprising segment pivotable about an end of the single broad side of the frame;

a hanger coupled to the top of the frame and configured to hang from an external support such that the frame extends vertically below the hanger; and a drawer comprising a first broad side, a second broad side opposite and parallel to the first broad side, and two narrow sides, the narrow sides unbounded by the frame when the drawer is in a storage position, wherein:

the first broad side of the drawer is slidably coupled to the single broad side of the frame and substantially parallel to the single broad side of the frame when the drawer is in a storage position, the second broad side of the drawer comprises two doors, each door hinged proximate one of the narrow sides of the drawer, the doors hinged at opposite edges of the drawer and in a plane parallel to the broad side of the frame, such that the interior side of each door, when at least partially opened, forms an angle greater than 90° with respect to the interior side of the narrow side of the drawer proximate which it is hinged, and the pivotable segment is arranged to pivot the drawer about the end of the single broad side of the frame such that the first broad side of the drawer is substantially perpendicular to the single broad side of the frame in an access position.

11. The storage unit of claim 10 further comprising one or more additional drawers slidably coupled to the frame.

12. The storage unit of claim 10 wherein the inside of the drawer is accessible through an opening in the second broad side of the drawer.

13. The storage unit of claim 10 wherein the interior of the drawer is accessible through the doors.

14. The storage unit of claim 13 wherein at least one of the doors comprises a storage pocket.

15. The storage unit of claim 10 wherein the interior of the drawer is accessible through an opening in the top of the drawer.

16. The storage unit of claim 10, wherein the drawer further comprises a rail pivotably coupled to a first one of the narrow sides of the drawer.

17. The storage unit of claim 16, wherein the rail is removably coupled to the inside of a second one of the narrow sides of the drawer.

18. The storage unit of claim 17 wherein an exterior of the second one of the narrow sides of the drawer comprises a grip.

19. The storage unit of claim 16, further comprising clips coupled to the rail.

* * * * *